US007699693B2

(12) United States Patent
Schwartz

(10) Patent No.: US 7,699,693 B2
(45) Date of Patent: Apr. 20, 2010

(54) ELECTRONIC CARD SYSTEM AND METHOD

(75) Inventor: Erez Schwartz, Tel Aviv (IL)

(73) Assignee: CDG Electrohex Ltd., Bney Brak (IL)

( * ) Notice: Subject to any disclaimer, the term of this patent is extended or adjusted under 35 U.S.C. 154(b) by 1134 days.

(21) Appl. No.: 10/526,219

(22) PCT Filed: Oct. 9, 2003

(86) PCT No.: PCT/IL03/00810

§ 371 (c)(1),
(2), (4) Date: Mar. 1, 2005

(87) PCT Pub. No.: WO2004/033056

PCT Pub. Date: Apr. 22, 2004

(65) Prior Publication Data

US 2006/0063576 A1 Mar. 23, 2006

Related U.S. Application Data

(60) Provisional application No. 60/417,624, filed on Oct. 11, 2002.

(51) Int. Cl.

| | |
|---|---|
| ***A63F 9/24*** | (2006.01) |
| ***A63F 13/00*** | (2006.01) |
| ***A63F 9/10*** | (2006.01) |
| ***A63F 9/12*** | (2006.01) |
| ***G06F 17/00*** | (2006.01) |
| ***G06F 19/00*** | (2006.01) |

(52) U.S. Cl. ..... 463/9; 273/157 R

(58) Field of Classification Search ..... 463/9, 463/14, 39, 43, 47; 273/153, 236, 242, 244.1, 273/244.2, 261, 275, 282.3, 286, 288, 289, 273/290, 342, 375
See application file for complete search history.

(56) References Cited

U.S. PATENT DOCUMENTS 4,624,462 A * 11/1986 Itkis ..... 273/237
5,026,058 A * 6/1991 Bromley ..... 463/3

(Continued)

FOREIGN PATENT DOCUMENTS

EP 1473067 * 4/2003

OTHER PUBLICATIONS

Risk Game Manual, Created on Jul. 15, 1999, Accessed on Sep. 2, 2008.*

(Continued)

*Primary Examiner*—Dmitry Suhol
*Assistant Examiner*—Reginald A. Renwick
(74) *Attorney, Agent, or Firm*—Nixon Peabody LLP.; Joseph Bach

(57) ABSTRACT

An electronic game card (1) comprising a controller and one or more communication devices (12), all contained within a planar card having three or more sides. The communication devices (12) allow communications between adjacent cards when two cards are placed close to each other, with one side of each card opposite a side of the other card. An electronic card game method comprising: Defining the number of participants in the game; setting up the game; each participant locates his/her cards on a flat surface, adjacent to each other; performing a setup procedure; automatically recognizing the game configuration; detecting and addition of a new card and automatically responding thereto.

16 Claims, 8 Drawing Sheets

U.S. PATENT DOCUMENTS

| | | | | |
|---|---|---|---|---|
| 5,324,040 | A * | 6/1994 | Panda | 273/272 |
| 5,455,749 | A * | 10/1995 | Ferber | 362/103 |
| 5,941,714 | A * | 8/1999 | Gorbet et al. | 439/38 |
| 6,464,503 | B1 * | 10/2002 | Heit et al. | 434/156 |
| 2002/0052238 | A1 * | 5/2002 | Muroi | 463/40 |
| 2005/0093232 | A1 * | 5/2005 | Stout | 273/153 R |

OTHER PUBLICATIONS

Internet Archive Wayback Machine, Search for Risk Game Manual, Internet Archive, Accessed Sep. 2, 2008.*

* cited by examiner

ELECTRONIC CARD SYSTEM AND METHOD

This Application is a National Stage application of and claims priority benefit from PCT/IL03/00810, filed on Oct. 9, 2003, which, in turns, claims priority benefit from U.S. Provisional Application Ser. No. 60/417,624, filed Oct. 11, 2002.

TECHNICAL FIELD

This invention concerns systems and methods for electronic cards. The invention relates in particular to electronic game cards and collection cards.

BACKGROUND ART

Prior art electronic games may use a board fitted with user interface means such as keyboards and electronic displays, in a fixed configuration.

One or more users can therefore play the game by activating the controls thereon and watching the corresponding display.

A disadvantage with such prior art games is their limited scope. After some time, the players may get bored with the game, as it loses its novelty. Moreover, the game program is fixed, thus limiting its performance.

It is an objective of the present invention to provide for a novel electronic card game overcoming the above detailed deficiencies.

SUMMARY

It is an object of the present invention to provide a system and method for electronic game cards and collection cards. This object is achieved by an electronic game card system as disclosed in claim 1.

In accordance with the invention, the object is basically accomplished by providing an electronic game card comprising a controller and communication means, all contained within a planar card having three or more sides. The communication means allow communications between adjacent cards when two cards are placed close to each other, with one side of each card opposite a side of the other card.

The cards are shaped so as to allow stacking cards in a bi-directional pattern. For example, the cards may be shaped as a planar triangle, square, pentagon or hexagon.

The cards may include user input means comprising push buttons, a keyboard or keypad or a combination thereof. The cards may include user output means comprising sound generating means, such as a loudspeaker or a piezoelectric device. Other output means may include display means.

An electronic card game comprises a plurality of stackable cards located on a bi-directional pattern adjacent to each other. Each card includes a controller and communication means.

In a preferred embodiment, each card has a controller and there are interactions between cards to form a distributed computer system as the cards are placed next to each other. There is no central controller in the game. In another preferred embodiment, one card is the master, its controller controlling the game, whereas the other cards are slaves with minimal computing power.

In one preferred embodiment, there is no need for a board for the game, since the cards themselves, as they are located on a table or a flat surface next to each other, act as the game board.

In another preferred embodiment, the cards can be placed on a special board. The board can give the cards support, power, etc.

The game goal may be for example to build a maze. Each player has part of a maze in the cards, and by adding them to the game he/she can enable routes or block routes for the opponent. The players can move a "soldier" on the cards that move on the maze.

An electronic card game method may comprise:

a. defining the number of participants and setting up the game;
b. setting up the game parameters;
c. detecting additions of cards and automatically responding thereto;
d. allowing each player to enter his/her input into the game and responding accordingly;
e. setting and updating individual parameters for each card;
f. allowing each player to add cards, replace cards or reactivate dead cards;
g. distinguishing between card additions during setup versus additions between rounds, and activating different routines in each case;
h. updating the parameters of the game responsive to a topology of the game, that is the location of the cards relative to each other;
i. finishing the game according to endgame criteria;
j. activating various sound and/or visual effects responsive to player's actions.

Further objects, advantages and other features of the present invention will become obvious to those skilled in the art upon reading the disclosure set forth hereinafter.

BRIEF DESCRIPTION OF DRAWINGS

The invention will now be described by way of example and with reference to the accompanying drawings in which.

DETAILED DESCRIPTION

A preferred embodiment of the present invention will now be described by way of example and with reference to the accompanying drawings.

Figure 1:
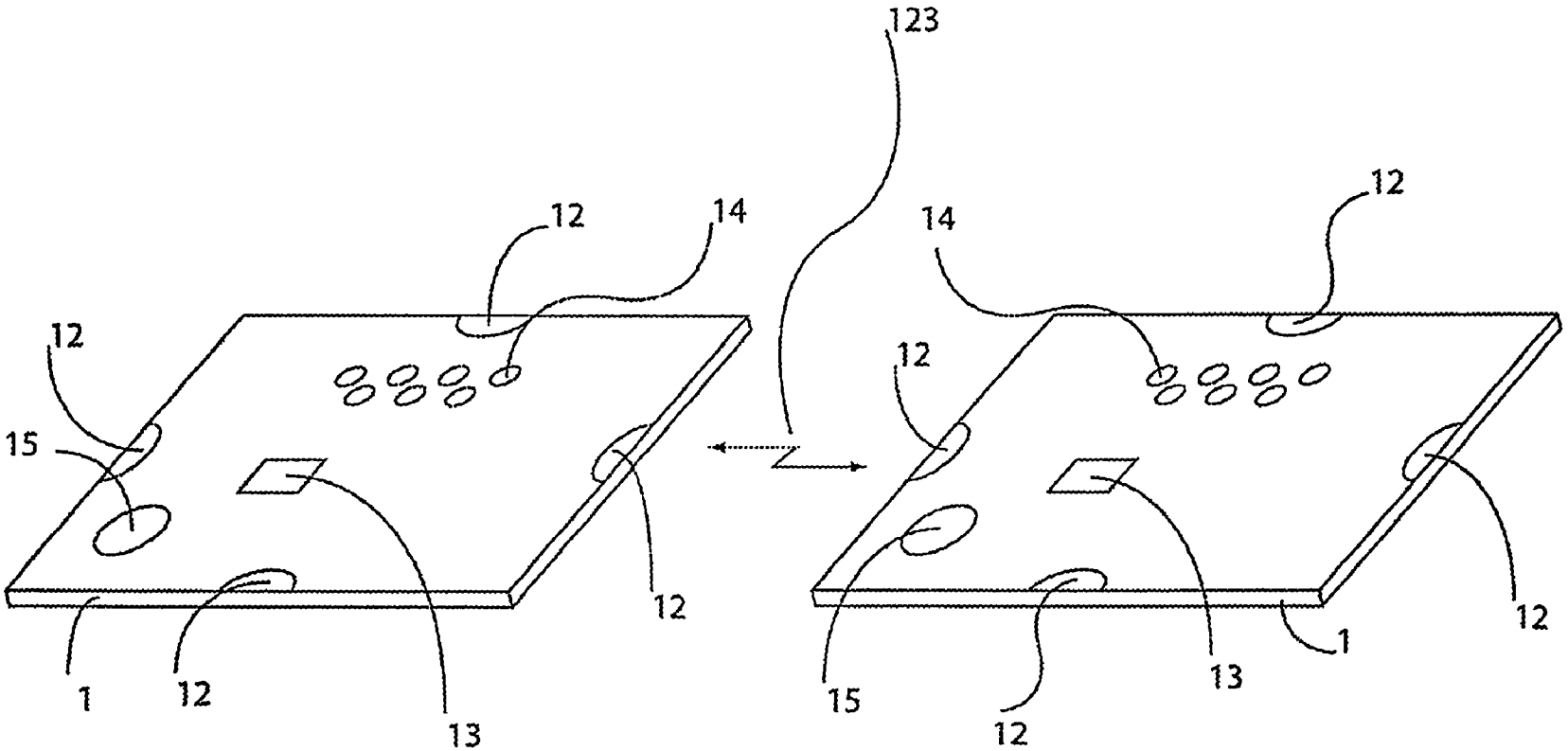
FIG. 1 illustrates one configuration of the game, comprising two cards with communications means therebetween FIG. 2 details a cross-sectional view of the electronic card

In one embodiment of the present invention, see FIG. 1, the game comprises a plurality of cards 1, each about half a centimeter thick. Each card may include a controller, one or more communication devices, user input means such as push buttons, sound producing means, and one or more light emitting diodes or LCD or similar display methods.

The stackable cards 1, rectangular in this example, can be located on a bi-directional pattern adjacent to each other. Each card includes means for joining cards together in a game, such as a controller and communication means.

In the present disclosure, numerous specific details are set forth in order to provide a thorough understanding of the invention. However, it will be understood by those skilled in the art that the present invention may be practiced without these specific details. In other instances, well-known methods, procedures, components and circuits have not been described in detail so as not to obscure the present invention.

Unless specifically stated otherwise, throughout the present disclosure, terms such as "processing", "computing", "calculating", "determining", or the like, may refer to the actions and/or processes of a computer or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display means.

Figure 2:
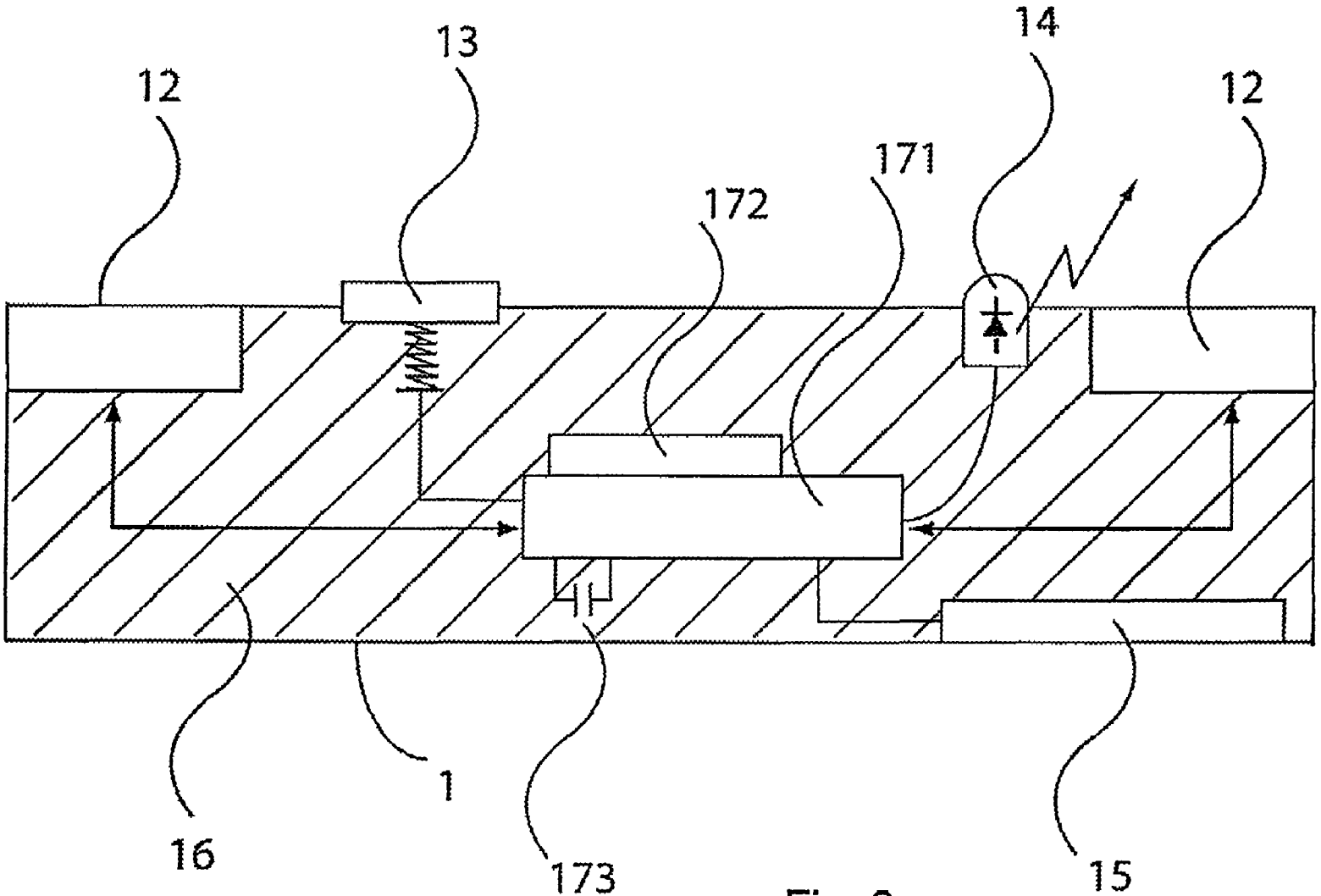

Embodiments of the present invention may include apparatus means for performing the operations therein, such as the electronic control means 171 in FIG. 2. Such apparatus may be specially constructed for the desired purposes, or it may comprise a general-purpose computer selectively activated or reconfigured by a computer program stored in the computer.

Such a computer program may be stored in a computer-readable storage medium, such as, but is not limited to, any type of disk including floppy disks, optical disks, CD-ROMs, magnetic-optical disks, read-only memories (ROMs), random access memories (RAMs) electrically programmable read-only memories (EPROMs), electrically erasable and programmable read only memories (EEPROMs), magnetic or optical cards, or any other type of media suitable for storing electronic instructions or data, and capable of being coupled to a computer system bus.

The processes and displays presented herein are not inherently related to any particular computer or other apparatus. Various general-purpose systems may be used with programs in accordance with the teachings herein, or it may prove convenient to construct a more specialized apparatus to perform the desired method. The desired structure for a variety of these systems will become apparent from the present disclosure. In addition, embodiments of the present invention are not described with reference to any particular programming language. It will be appreciated that a variety of programming languages may be used to implement the teachings of the inventions as described herein.

FIG. 1 illustrates two cards 1 in accordance with one embodiment of the present invention. The cards 1 may communicate with one another through one or more communication devices 12 contained in each card.

The communication device(s) 12 on a card 1 may either use an optical, radio frequency and/or direct contact communication (ohmic) link to communicate with a corresponding communication device 12 on a second card nearby. Communication devices of sufficiently small dimensions to fit on or within a card are well known in communications. For example, the communication device may include a LED as an optical transmitter, a photo sensor as a receiver, and single chip coder/decoder to:

(1) convert outbound data into modulated electric pulse to drive the LED, and (2) to convert the output of the photo sensor into an inbound data stream.

FIG. 1 thus illustrates one configuration of the game, comprising two electronic cards 1 with communications means 12 therebetween. The communications devices 12 of two adjacent cards form a communication channel 123.

The manual input means 13 in each card may include push buttons, a keyboard and/or keypad, etc.

The display means 14 may include Light Emitting Diodes (LEDs), LED matrix, Liquid Crystal Display (LCD), etc.

The sound generating means 15 may include a loudspeaker, a piezoelectric device, etc.

In the embodiment as illustrated, the electronic card 1 is square shaped, this allowing to connect cards by placing them close to each other in two dimensions, as further illustrated in FIGS. 3, 5 to 8.

The cards may have other shapes that allow grouping the cards in two dimensions, such as a hexagonal shape (See FIG. 4), triangular or another bi-directional stackable shape.

Sound generating means can be installed in all the cards or in only part of the cards.

Electrical power can be transferred between cards. Data and power can be transferred over common pins between cards.

The cards may further include means for connecting to a personal computer for control, upgrade and/or sound generation.

In a preferred embodiment, each card 1 has a controller and there are interactions between cards to form a distributed computer system as the cards are placed next to each other. There is no central controller in the game. In another preferred embodiment, one card is the master, its controller controlling the game, whereas the other cards are slaves with minimal computing power. The latter (master/slave) structure is further detailed with reference to FIGS. 5, 6, 7 and 8.

Throughout the present disclosure, it is to be understood that, unless otherwise stated, the game methods and game structure embodiments may apply to both of the two above-detailed embodiments.

FIG. 2 illustrates a cross sectional view of an electronic card 1 according to a preferred embodiment of the present invention. A controller 171 within the card may contain logic circuits, programmed with certain functional logic (e.g. game logic and/or rules—in the event the card is used as a game card). The controller 171 may either contain memory means and/or may be connected to non-volatile memory means 172, such that certain values associated with the function of the card may be stored in the non-volatile memory 172.

In one embodiment, memory means are only installed in the master card. In another embodiment, memory means are also installed in slave cards. This may increase the cost of the slave cards, however it may enable each card to preserve its individual status, which may change during the game.

The controller 171 may receive a user input in the form of an electric signal produce when a user engages a button 13 on the card. Electric buttons/inputs/actuators 13 are well known, and any such device, known today or to be devised in the future, may be used with the present invention.

Upon engaging a button 13 on a card 1, a signal to the controller 171 may activate the controller 171 and may cause the controller to produce a communication signal in accordance with some predefined logic or rules. The communication signal may be transmitted by one or more of the card's communication device(s) 12.

In addition to transmitting a communication signals to other cards, the controller 171 on a first card 1 may also receive a communication signal from a controller on another card. The other card may or may not be the same card to which the first card transmitted a communication signal. In some embodiments of the present invention, a card will both transmit and receive data when a user activates the controller.

Each card may transmit information to the master card, which controls the game serving as its "brains". As each player pushes a button on a first slave card to indicate an attack, then on a second slave card to designate its target, the apparent impression is of communications between the two slave cards. Actually, each slave card relays the input information to the master card, which decides the outcome of the move and activates output means accordingly. The players, however, get the impression of direct interactions between two slave cards.

The communication signals exchanged by two cards 1 may relate to any one of a number of possible transactions permitted in the course of the game. For example, the data exchanged may represent digital money, personal contact information, game-related data, etc. Information relating to, or derived from data received by a card may be stored on the card's non-volatile memory.

The exchanged data may be used to determine the location of the cards with respect to each other. In a preferred embodiment, this determination is made at the master card. The location of the cards may be used, together with the rules of the game, to decide the outcome of each move, successes and losses of players, and to declare the winner.

A card may also include one or more light emitting diodes (LED) 14 and one or more sound producing devices 15 (e.g. piezoelectric speaker). The LED 14 and/or sound producing devices 15 may be activated by a card's controller 171 as a means of communication with a user. Information relating to the condition of the card 1 and information relating to the status of a transaction with a second card 1 may be communicated to a user of the card as a series of lights flashes and/or sounds.

In one embodiment of the present invention, each card 1 may represent a character in a role-playing game such as Dragons and Dungeons.

Statistics and/or status information about a character may be stored on a card's non-volatile memory 172. The game logic for the role-playing game may be contained in the controller 171 and/or the non-volatile memory 172.

When using a master/slave embodiment, a slave card may include generic base card which holds and supports a detachable cover card. In this case, the cover card provides two elements:

1. graphics which exclusively expresses and describes a specific character, one out of hundreds or thousands characters.
2. a corresponding electronic (coded) description thereof that can be identified by any slave card when attached to it.

The base card may be about 3 mm thick, and the detachable cover card may be thinner, about 1 mm thick for example.

Examples of possible embodiments of the game:

1. The slave cards each contains a personality of that card;
2. The slave cards are generic and identical, however they allow for mounting coded detachable thin cover cards thereon, with the detachable cover cards storing each a unique personality.

The codes in the cover cards and slave cards may include a bar code, electrical contacts, a smart card, resistivity, mechanical lugs, etc. A 32 bit code may be used.

A sound generating means 15 is located in the master and/or slave card, to emit sounds into the ambient.

A communications devices 12 may be located within the card 1.

The electronic control means 171 may include a controller, microcomputer, microcontroller, etc. or similar means to control the operation of the device, the interaction with the user through means 13 and 14, and the communications with other cards through means 12.

The memory means 172 may include means such as RAM, ROM, EPROM, EEPROM, Flash memory, etc. In a preferred embodiment, the memory may include a replaceable module with additional programs and/or description of the character emulated in each slave card or detachable thin cover card. The characteristics of that character may be changed by replacing the memory card. A nonvolatile memory is required in this case.

A battery 173 provides electric energy to the card(s). The battery 173 is optional—electrical energy may be supplied from an adjacent card, or from one card to all the other cards connected together to form the game. A battery in each card saves the need to transfer power between cards, however using a common source of energy saves the need to periodically replace or charge a plurality of batteries and more—it lowers significantly the cost of each slave card and makes it even more affordable to the user.

A substrate 16 may be made of paper, cardboard, plastic, wood or another material.

Figure 3:
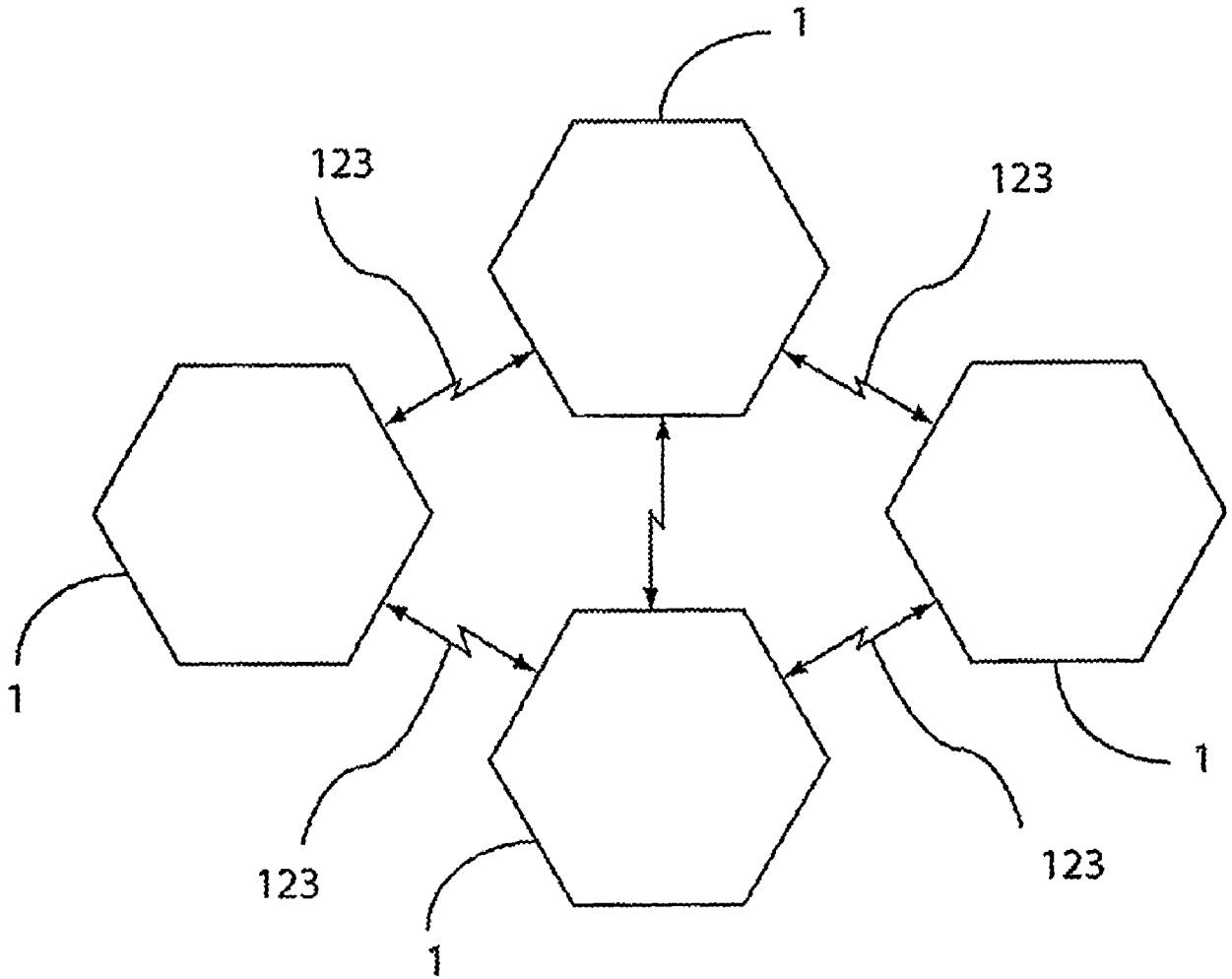
FIG. 3 illustrates a game configuration comprising a plurality of cards communicating with each other FIG. 4 details the structure of a card

As two or more cards 1 are brought into proximity with each other, see for example FIG. 3, and each card is activated, the cards may communicate with one another through communication channels 123 and may engage in a series of transactions or engagements simulating a game such as Dragons and Dungeons.

An example of a possible game method is detailed below (a game logic table), which may be used to implement a role-playing game on a series of cards according to one embodiment of the present invention.

The information stored on a card's non-volatile memory may include such parameters as the card's inherent value or strength in certain areas. For example, on a card representing a "Prince Character", the card may store different values in different memory areas representing different game-related attributes such as for example: fighting=5, commerce=7, charm=15, etc.

Components of the game in this example:

1. One master card
2. Five slave cards for each player

Each slave card may accept any of tens of detachable thin cover cards, each coded with specific characteristics.

Examples of two game configurations:

1. Each personality is fixedly attached to a slave card or in other words: each slave card holds non separate personality as a part of it.
2. The detachable thin cover cards are separate from the slave cards and may be attached to slave cards by the players.

In both configurations: Each time a slave is connected to the game, its code is transferred to the master card, which recognizes it and continues the game accordingly. Both the slave characteristics and its location affect the game.

Game Method #1

1. The game may be played by one or more participants. The game may include a plurality of rounds, with a turn for each participant in each. Between the rounds, additional activities may be allowed, for example adding or removing cards from the game, thereby changing its configuration.
2. At the beginning of each game, a setup procedure is performed. Each player may add one or more cards to the game board. The game parameters are set up, including various values such as the number of players, etc. The initial values may include by default the values of the previous game. The master card may automatically recognize the game configuration by communicating with the other cards connected in the game. Each card allows signals to communicate between cards adjacent thereto, such that all the cards are functionally connected.
3. The master card detects any addition of a new card and automatically proceeds to the next player. A voice indication may acknowledge the card connection. Pressing the "Start" button on the master card starts the game.

4. During the game, each player can only operate cards during his turn. There may be a predefined time period allocated to each player. After each player's turn, the game points to the next player. Alternately, a dedicated button switches the system to the next player.
5. Each card may have a set of parameters, defining its status. At the beginning of the game, each card may be set to a default value. At some cases, a card may be declared dead or inactive. In this case, a corresponding indicator is activated, for example a LED turning OFF. An inactive card will not respond to a participants commands, however it remains active electronically, for example to relay signals between adjacent cards or to be reactivated by the master card. It may participate in display effects as initiated by the master card.
6. After each round in the game, according to the rules of the game as stored in the master card, players may have an opportunity to add cards, replace cards or activate dead cards. The rules may forbid removal of cards, permitting only their replacement. The master card supervises the activities performed by the participants, including the activation of each card, as well as cards removals, additions or replacements. If a forbidden activity is performed, the master card will give an adequate indication and may activate/deactivate each card according to the rules of the game.
7. The system may distinguish between card additions during setup versus additions between rounds, and may activate different routines in each case. In the former case, the parameters in all the cards may be set to their default values, whereas in the latter case only the additional cards may be set to their default values. A card being reactivated may return to its last known state, with its corresponding values.
8. The topology of the game (the location of the cards relative to each other) affects the operation of the game. The parameters affected by the topology may include the game speed, the routines activated, the relative performance of characters, etc. Thus, the game method is topology-sensitive.
9. The game is finished when only cards belonging to one player remain active on board, or when the Master Card is "captured" by one of the players, or when all the player's cards become inactive. Other criteria for game end may be defined as well.
10. The game may include various sound and/or visual effects, which may be activated from the Master Card, responsive to player's actions. Such effects may include concurrent activation of display means in a plurality of cards, and/or concurrent generation of sounds in various cards. Such effects may dramatically enhance player's involvement in the game and their pleasure therein.

End of Method.

Game Method #2

1. Setting up the game by connecting cards to each other in a bi-dimensional pattern. The cards may correspond to one or more participants.
2. Initial system set-up. The master card communicates with all the connected cards, learning the present topology. The rules of the game may include fixed rules and additional rules defined by the topology. Alternatively, the actual rules of the game are affected by the topology.
3. Playing the game, wherein each player in his/her turn activates controls in one or more cards.
4. The master cards responds to each player's actions by:
   a. checking their compliance with the rules of the game, accepting legal actions and rejecting illegal actions.
   b. responding to acceptable actions with audio/visual responses and/or changing the status of the various players and their cards, according to the rules of the game.
5. Playing the game, wherein each player in his/her turn adds, removes, activates and/or deactivates their cards.
6. The master card responds to each player's actions by:
   a. checking their compliance with the rules of the game, accepting legal actions and rejecting illegal actions.
   b. responding to acceptable actions with audio/visual responses and/or changing the rules of the game and the status of the various players and their cards, according to the rules of the game.
7. Repeating steps 3 to 6 until a winner is declared, according to the rules of the game.

End of Method.

In addition to storing a card's inherent value(s), the non-volatile memory may also be used to store data related to a card's condition, score and/or status. For example, in the context of a money card, the non-volatile memory may store digital data representing digital currency.

In the context of a game card, using Dragons and Dungeons for example, the non-volatile memory may store a card's score. For example, if a particular card has a history of many favorable engagements with other cards, and thus has collected many points during each engagement, the large number of points collected by a card may be stored in the card's memory. Conversely, if a card has been engaged in a number of losing engagements with other cards, the low score may also be stored in the card's non-volatile memory. The low score may be stored in the master card, which will identify each coded slave card to join the game. In this case, there is no need to store game information in the slave cards.

Figure 4:
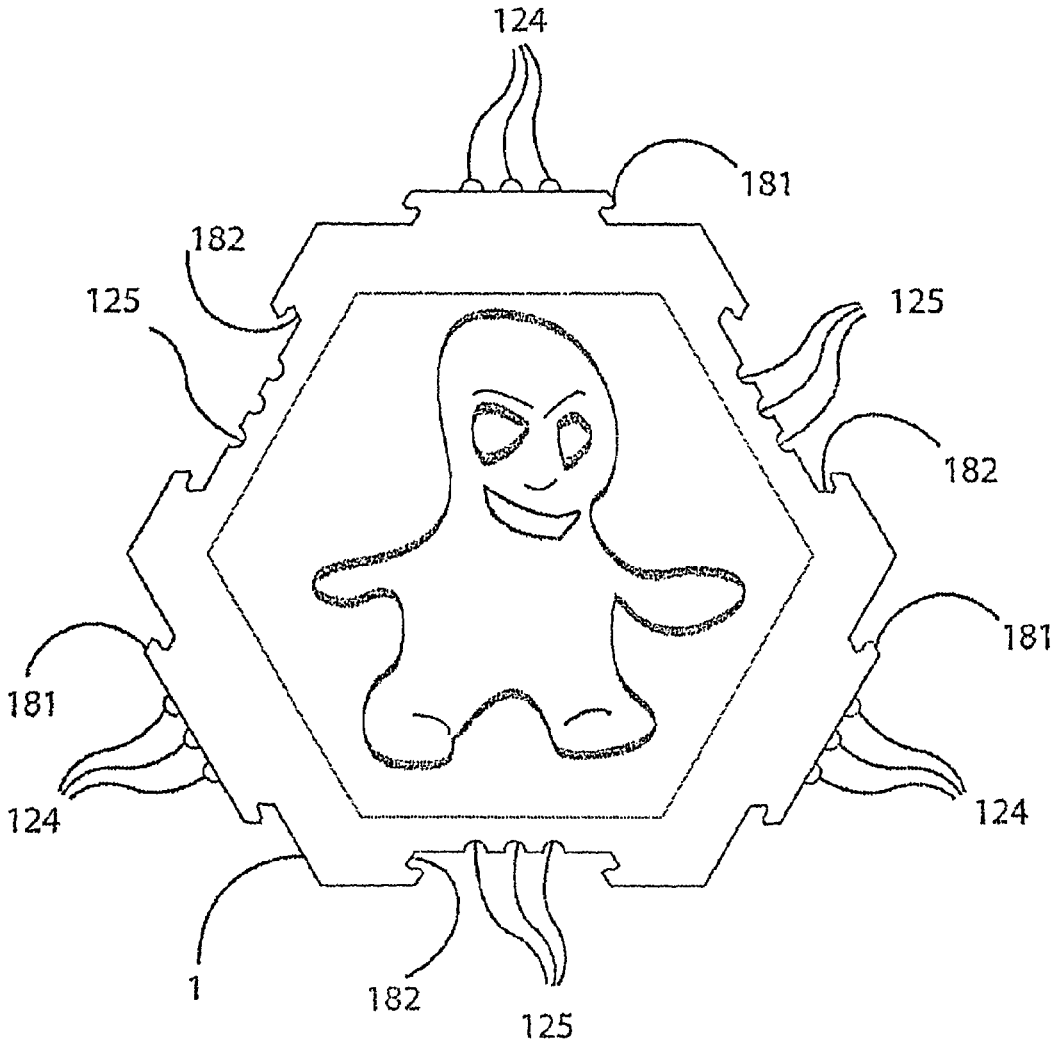

FIG. 4 details the structure of an electronic card 1, hexagonal in this embodiment. Each side of the card may include either male mechanical holding means 181, or corresponding female mechanical holding means 182. Furthermore, each side may include a communications device, in this embodiment either male ohmic contacts 124 or corresponding female ohmic contacts 125.

The male contacts 124 may be spring-loaded, to allow easy assembly of cards together, wherein these contact protrude into their female counterparts 125. The three contacts may include Ground, In/Out communications and electrical power (DC), respectively.

The electrical power contact is optional, in case it is desired to transfer electrical between adjacent cards, or from one card to all the other cards connected together to form the game. It is not needed when a battery is included in the slave, or when the data contact is also used to transfer power.

The illustration on the upper side of the card 1 may refer to the character emulated by that card, etc. Furthermore, the upper side of card 1 may also include manual input means, display means, sound generating means, etc.

In a preferred embodiment, there are two basic types of cards, the master card the slave card. The master card controls the game, communicating with all the slave cards. Slave cards may include each a detachable thin cover card.

The game parameters stored in the master and/or in the slave cards may include the characteristics of each slave card.

An Example of a Game Logic Table

| Name | Life | Energy | Hit | Defense |
|---|---|---|---|---|
| Wolverine | 100 | 150 | 15 | 11 |
| Cyclops | 70 | 100 | 12 | 11 |
| Jean Grey | 60 | 80 | 12 | 8 |
| Rogue | 90 | 120 | 11 | 9 |
| Storm | 90 | 130 | 6 | 9 |
| Mystique | 70 | 80 | 11 | 9 |
| Spiderman | 140 | 140 | 13 | 12 |

Each slave card or detachable thin cover card may have a unique identity number.

Figure 5:
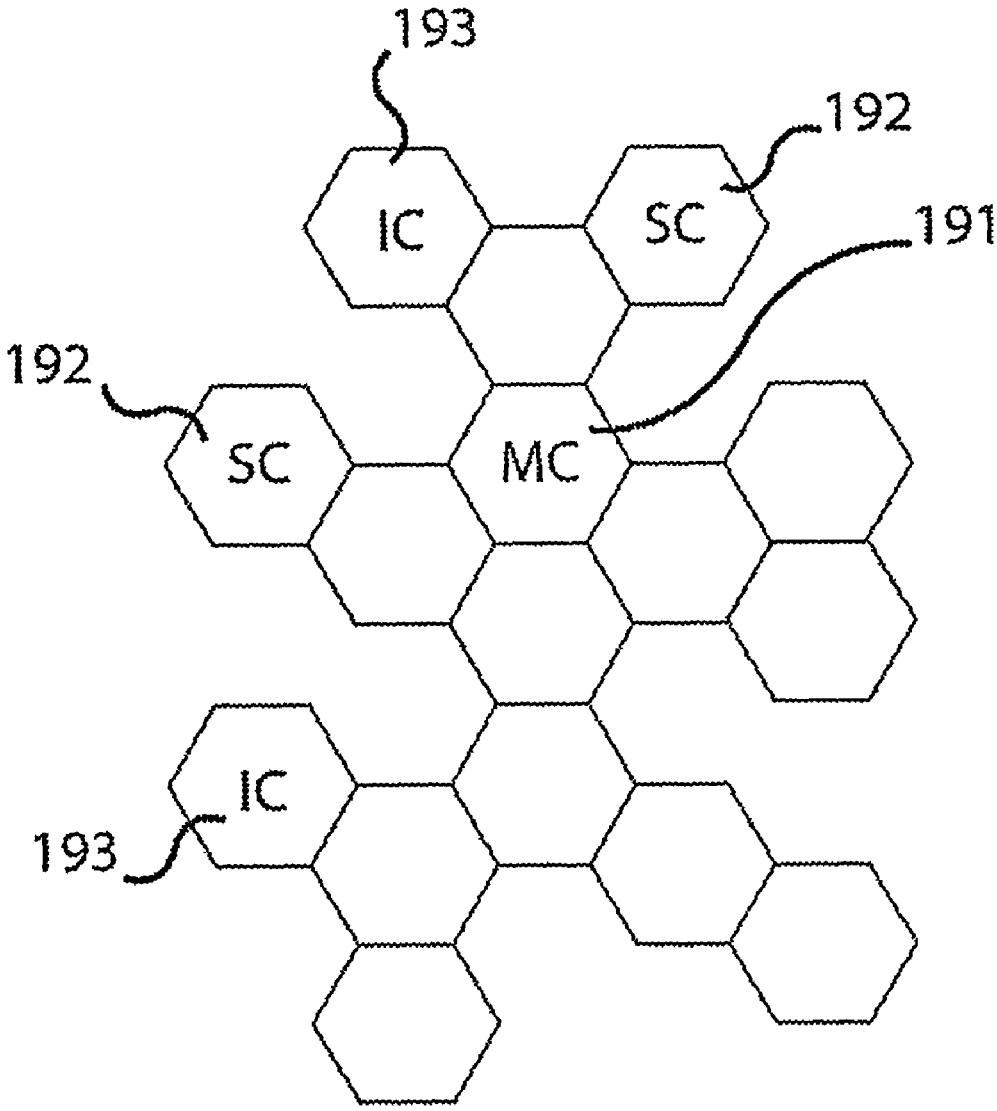
FIGS. 5, 6 and 7 illustrate three possible configurations of the game using a plurality of connected cards FIG. 8 details communication channels between the cards in a game
Figure 6:
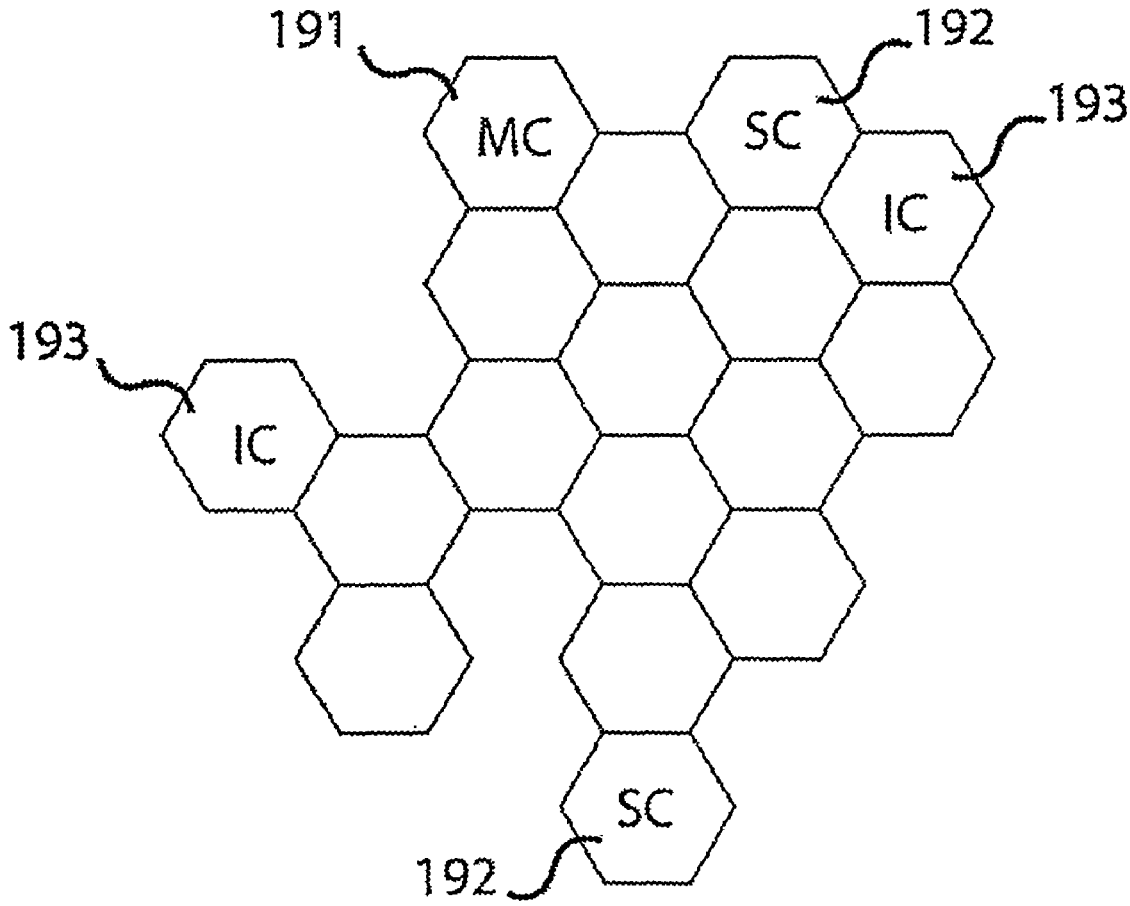
Figure 7:
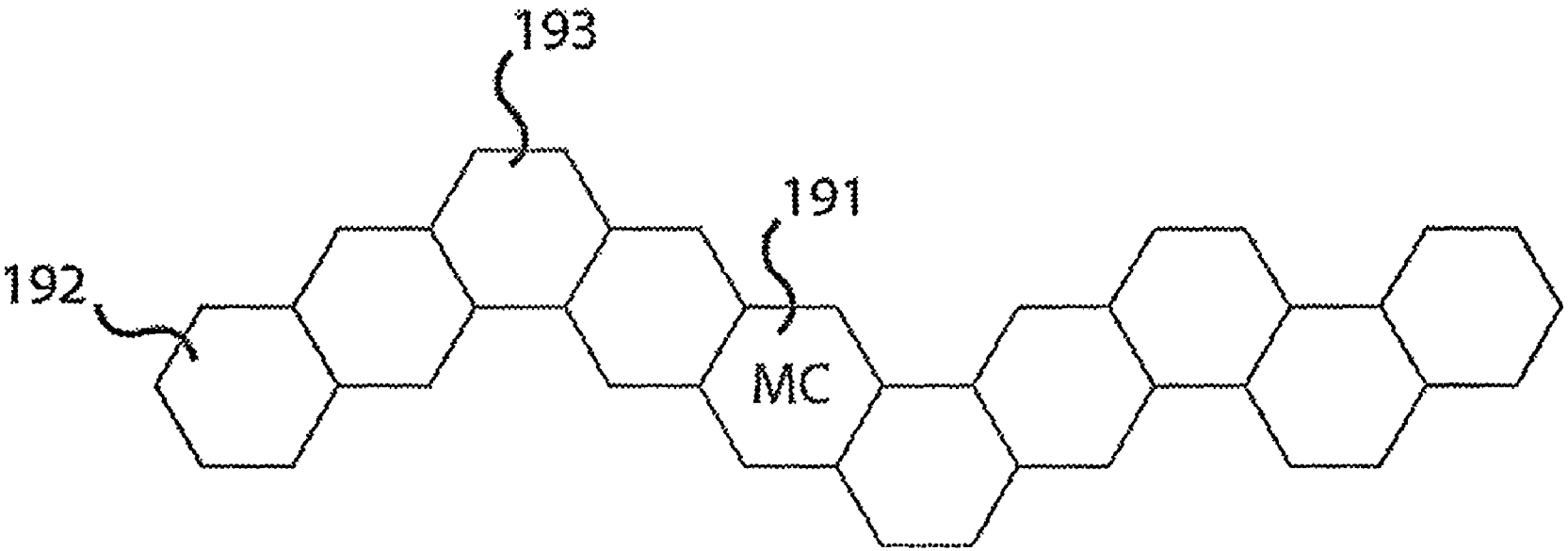

FIGS. 5, 6 and 7 illustrate three possible configurations of the game using a plurality of connected electronic cards. In the preferred embodiments illustrated in FIGS. 5, 6, 7 and 8, one card is the master, its controller controlling the game, whereas the other cards are slaves with minimal computing power. The cards themselves may be each of one of several types, as indicated: a master card 191, an active slave card 192 or an inactive slave card 193.

One of the cards may be a master card, including means for communicating with the other cards and for controlling the game. In this case, the other cards may be slaves, controlled by the master card.

In one embodiment, each slave card is made of one piece. In another embodiment, each slave card comprises a base and a detachable cover, wherein the cover holds the identification and specific properties for the slave card.

Master card: belongs to one of the players and controls the game, communicating with all the slaves of all players equally. The master card may hold all the necessary hardware, software, processor, memory, loudspeaker, energy source, LED's, push buttons, etc., to manage and support the whole game. An important feature of the present invention is that master card is in the same two dimensional size of the slave cards so it can perfectly fit in any location in the overall layout of the slave cards, but the master card may be higher with respect to the slave cards, so it can contain all the elements described above to support the game.

Slave card: each belongs to one of the players; they are low cost, allowing players to accumulate a plurality thereof. In case The "personality" of each slave card is contained in the specific slave card itself, then it is no need for the detachable cover cards in the game.

Detachable thin cover card: each belongs to one of the players; they are very low cost, allowing players to accumulate easily a plurality thereof. In case the "personality" of each slave card is contained in the detachable thin cover card, the slave card would be generic, without uniqueness or any identification and is used only as a platform to hold and support the detachable thin cover card.

In this case, the detachable thin cover card provides two elements:

1. graphics which exclusively express and describe a specific character, one out of hundreds or thousands characters.
2. the detachable thin cover card holds corresponding electronic (coded) description thereof that can be identified by any slave card when attached thereto.

In a preferred embodiment, sound generating means are only installed in the master card. Alternately, they may also be installed in slave cards.

The master card controls the game and declares a winner. It may activate or deactivate the slave cards and may generate the various sounds and visual effects.

Preferably, the power source is located in the master card, with power being transferred to the slave cards through interconnections therebetween.

The user can connect the master card to a PC to transfer voice files, upgrades from the manufacturer via the Internet or from media bought from a store. The customer can buy tiny memory devices from toy stores, for example, to be installed in the master card.

Figure 8:
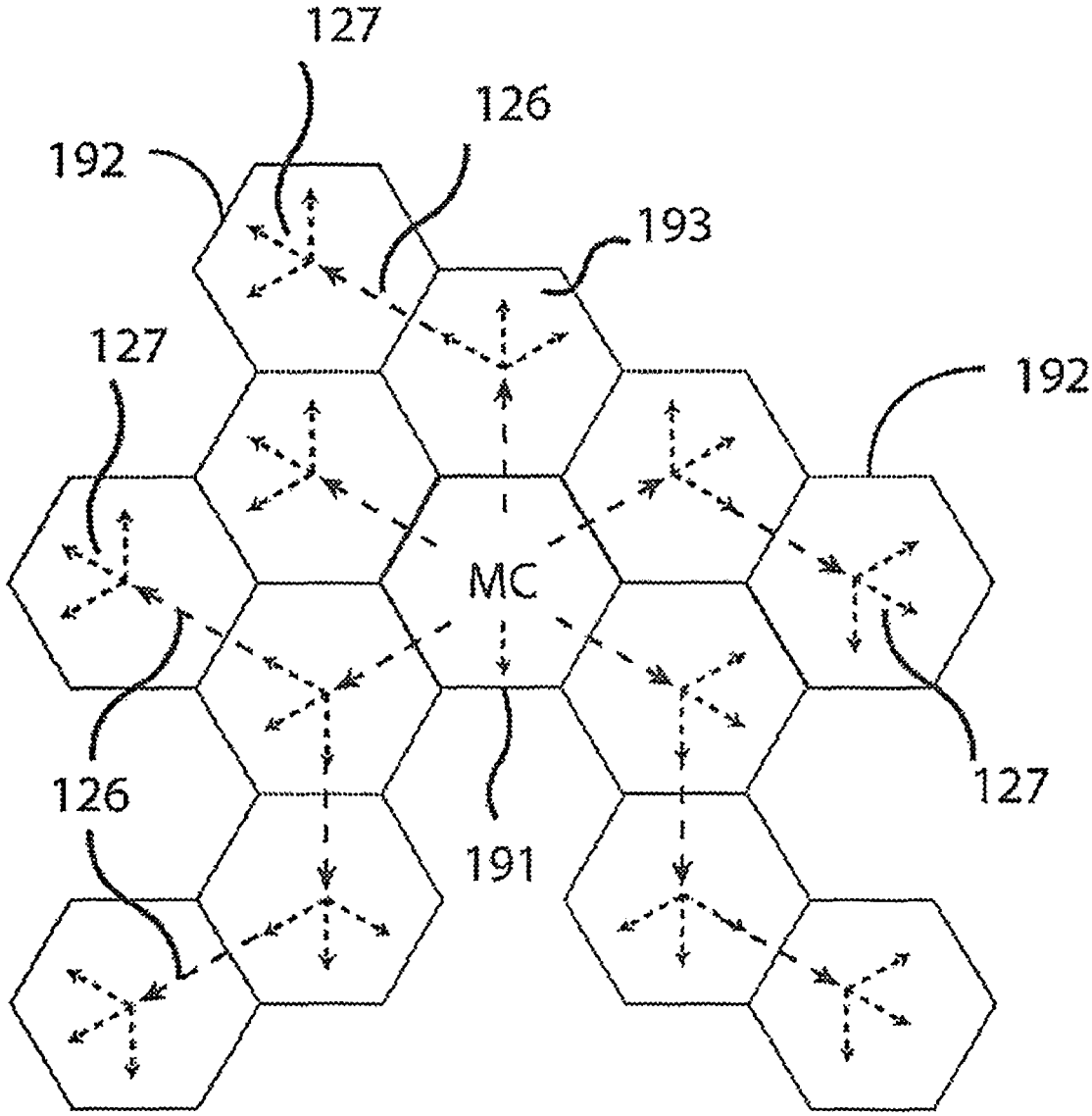

FIG. 8 details communication channels between the cards in a game. The cards may include: master card 191, active slave card 192 and/or inactive slave card 193. According to the topology of the game, there are formed active channels 126 and/or inactive channels 127.

Various methods may be used for communications between cards in the game. Following is an example of such a method.

Electronic Card Game (ECG) Communications Protocol

The following is a short description of a communications method:

The ECG protocol enables a low bandwidth, half-duplex data transfer over a network comprising a single Master and multiple Slave nodes connected to each other by means of point-to-point communication links (i.e. all links are electrically isolated; maximum one link is formed between any two nodes).

The number of maximal Slave nodes is limited only by the quality of communication links and the maximal acceptable delays. The specific types of the links (layer 1) is not important besides the fact that a "Start of byte" indication the received data should be provided for higher layers. It is implied that each Slave node has also a bridging capability with rules specified by the ECG protocol.

Furthermore, the protocol is characterized by:

1) Hot Slave insertion/removal support, including position detection of the new cards
2) Low propagation delays
3) Robustness and high noise resistance
4) Dynamic routing
5) New cards authentication
6) Encryption (optional)

End of method.

It will be appreciated that, for simplicity and clarity of illustration, elements shown in the figures have not necessarily been drawn to scale. For example, the dimensions of some of the elements may have been exaggerated relative to other elements.

While certain features of the invention have been illustrated and described herein, many modifications, substitutions, changes, and equivalents will occur to those skilled in the art. The scope and spirit of the present disclosure includes the various modifications, substitutions, changes, and equivalents, which will occur to those skilled in the art.

It will be recognized that the foregoing is but one example of an apparatus and method within the scope of the present invention and that various modifications will occur to those skilled in the art upon reading the disclosure set forth hereinbefore.

The invention claimed is:

1. An electronic game card comprising:

a planar card having three or more sides and a top surface, and forming a platform for holding a detachable thin cover card;

controller means in the planar card;

one or more communication means in the planar card and coupled to the controller means, wherein the communications between adjacent cards when two cards are placed close to each other, with one side of each card opposite a side of the other card;

user input means coupled to the controller means; and a code reader coupled to the controller means and configured to read a card code from the detachable thin cover card coupled to the top surface of the planar card;

wherein the planar card is generic and the thin cover card contains electronic coded description thereof.

2. The electronic game card according to claim 1, wherein the planar card is shaped so as to allow stacking planar cards in a bi-directional pattern.

3. The electronic game card according to claim 1, wherein the planar card is shaped as a planar triangle, square, pentagon or hexagon.

4. The electronic game card according to claim 1, wherein the user input means include push buttons, a keyboard or keypad or a combination thereof.

5. The electronic game card according to claim 1, further including a user output means.

6. The electronic game card according to claim 5, wherein the user output means include sound generating means.

7. The electronic game card according to claim 6, wherein the sound generating means include a loudspeaker or a piezoelectric device.

8. The electronic game card according to claim 5, wherein the user output means include Light Emitting Diodes (LEDs), LED matrix or Liquid crystal Display (LCD).

9. An electronic card game comprising:

a plurality of cards located on a bi-directional pattern adjacent to each other, wherein each card includes a controller and one or more communication devices, and wherein one of the cards is a master card operable to communicate with each card and to activate an output of each card according to rules of the games stored therein, wand the rest of the cards are generic slave cards each having a personality contained in a detachable thin cover card coupled to a top surface of the generic slave card, each thin cover card having code description thereof that can be identified by any of the slave cards when attached thereto.

10. The electronic card game according to claim 9, wherein each slave card comprises a generic base for receiving the detachable thin cover card and means for reading the detachable thin cover card code.

11. The electronic card game according to claim 10, wherein each detachable thin cover card contains both a graphic description and a corresponding coded description thereof.

12. The electronic card game according to claim 9, wherein each slave is assigned a unique personality code.

13. The electronic card game according to claim 9, wherein the master card further comprises a power source and interconnections to transfer power to the slave cards.

14. The electronic card game according to claim 9, wherein the master card further comprises connector to a personal computer.

15. The electronic card game according to claim 9, wherein the master card further comprises installable memory device.

16. The electronic game card according to claim 1, wherein the means for allowing communications between adjacent cards includes means for allowing power transfer between adjacent cards and means for allowing data transfer between adjacent cards.

* * * * *